US006471333B1

(12) United States Patent
Powell et al.

(10) Patent No.: US 6,471,333 B1
(45) Date of Patent: Oct. 29, 2002

(54) METHOD AND APPARATUS FOR KEYING INK SUPPLY CONTAINERS

(75) Inventors: Dan Powell, Corvallis, OR (US); Rhonda L. Wilson, Monmouth, OR (US); Elizabeth Grev, Corvallis, OR (US); Gary Douglas Powell, Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/846,128

(22) Filed: Apr. 30, 2001

(51) Int. Cl.[7] ..... B41J 2/175
(52) U.S. Cl. ..... 347/49; 347/86
(58) Field of Search ..... 347/49, 85, 86, 347/87; 399/12

(56) References Cited

U.S. PATENT DOCUMENTS 5,970,273 A 10/1999 Zenk et al. ..... 399/12
6,010,210 A 1/2000 Wilson et al. ..... 347/85
6,017,118 A 1/2000 Gasvoda et al. ..... 347/86
6,183,077 B1 2/2001 Hmelar et al. ..... 347/86
6,267,475 B1 * 7/2001 Lee et al. ..... 347/86
6,290,346 B1 * 9/2001 Santhanam et al. ..... 347/86

* cited by examiner

*Primary Examiner*—Anh T. N. Vo
(74) *Attorney, Agent, or Firm*—Larry D. Baker

(57) ABSTRACT

Embodiments of the present invention comprise containers for consumable substances, such as ink, and the corresponding receiving stations, such as inkjet printers. The containers and receiving stations have mating keying features indicative of a characteristic of the consumable substance, such as the ink family. Embodiments of the mating features include protuberances with a T-shaped cross section, and corresponding T-shaped slots. Preferred embodiments of containers and receiving stations are disclosed having two keying features with four unique orientations per feature, for a total 16 key permutations.

7 Claims, 18 Drawing Sheets

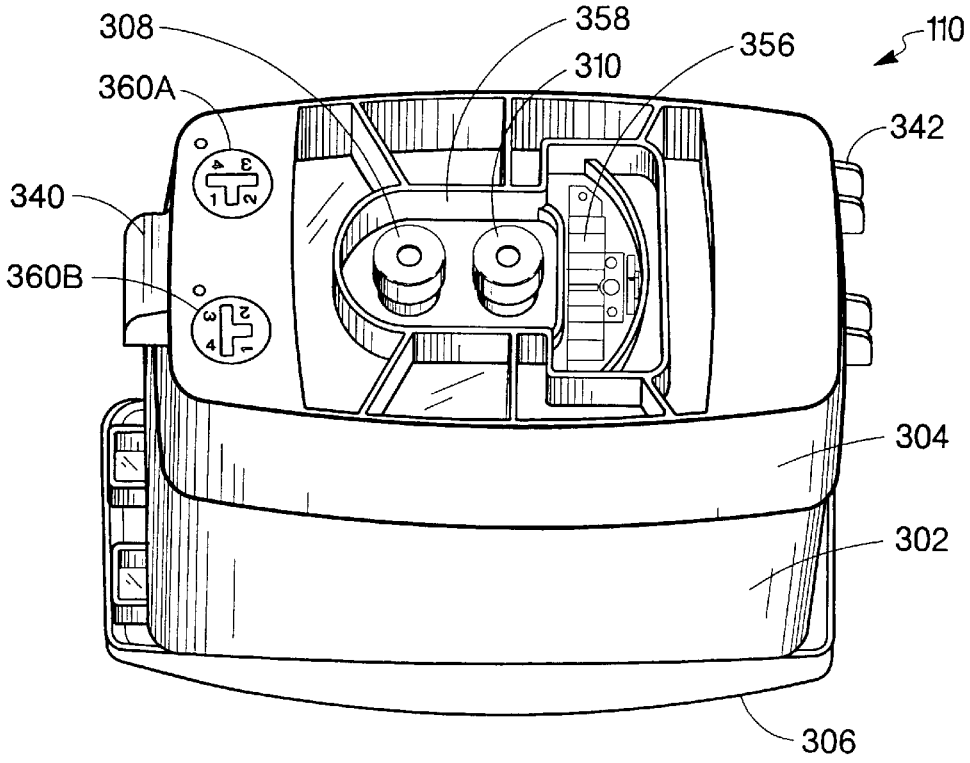
Fig. 4
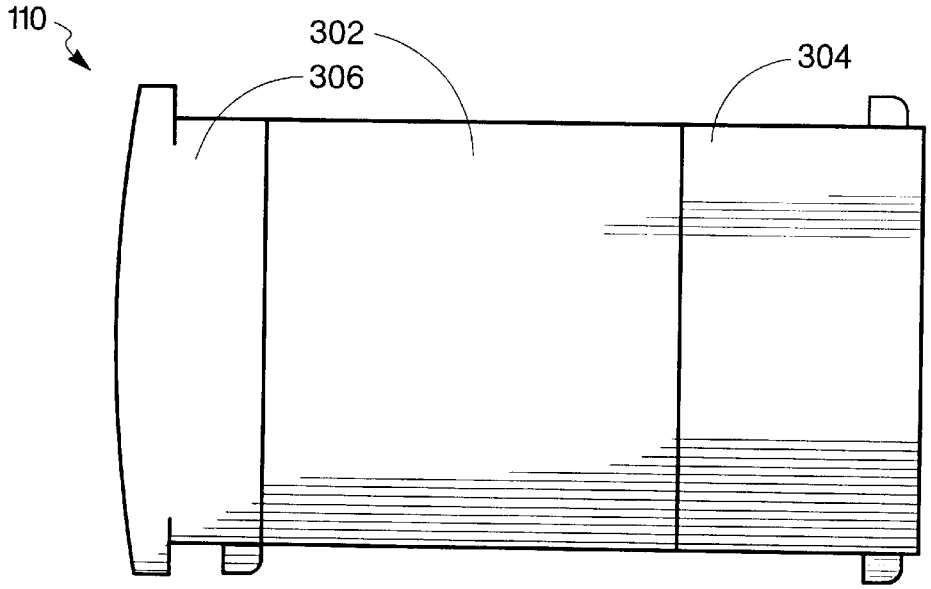
Fig. 5
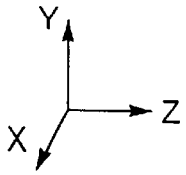

METHOD AND APPARATUS FOR KEYING INK SUPPLY CONTAINERS

TECHNICAL FIELD OF THE INVENTION

The present invention relates to a system for ensuring that a replaceable ink container is properly installed into the correct mating receptacle of a printer.

BACKGROUND OF THE INVENTION

A typical ink-jet printer has a pen mounted to a carriage which is moved back and forth over printing media, such as paper. The pen carries a print head. As the print head passes over appropriate locations on the printing media, a control system activates ink jets on the print head to eject, or jet, ink drops onto the printing surface and form desired images and characters.

Some ink-jet printers use stationary ink supplies that are mounted away from the carriage and that supply ink to a refillable ink reservoir built into the pen. The ink may be supplied from the supply container to the pen through a tube that extends between the pen and the container. Such supplies are termed "off-axis".

Color ink-jet printers typically combine four ink colors (black, cyan, yellow and magenta) to create a multitude of colors on the printing media, and therefore typically include a replaceable supply container for each color used by the printer. A group of pens, each dedicated to a particular color, are mounted to the printer carriage. A separate ink delivery system for each color of ink is required.

Specifically, the entire path for one color of ink from its supply container to the pen and out the print head is dedicated for use by a single color of ink. Accordingly, a four-color ink-jet printer is configured to incorporate four discrete ink delivery systems, one for each color.

Other printing systems may use a larger number of separate supplies and printheads, either to improve the image quality or to apply substances below or on top of the ink to better preserve the image.

Some ink-jet printing systems also provide for different classes or families of ink for use with different models of printers or different applications. For example, a printer designed to provide a very high quality print output may use ink having chemical and physical properties that are unlike the inks used with less-costly printer designs or families.

Contaminating one color ink with another, such as by introducing an ink of one color into the ink delivery system of another color, can degrade the color print quality. Moreover, directing the ink of one family into the delivery system of another family can prove disastrous for a printer. For example, if two black inks from different families are mixed together as a result of replacing one supply with the other, the mixture could react to form a precipitate and clog the ink delivery system, resulting in failure of the printer.

It is generally not a problem keeping inks of different colors and different ink families separated in printers that make use of replaceable cartridges having an integrated printhead and ink storage container. Because the entire ink supply, printhead and ink conduit between the ink supply and printhead are replaced with the ink cartridge there is generally not a potential for inks of different colors or families to mix. In contrast, there is great opportunity for inks of different ink families or different ink colors to become intermixed in printers which make use of ink storage units that are replaceable separately from the printhead. Replacing the ink storage unit with an ink color or ink family that is different from the previous ink storage unit results in the mixing of ink from the replacement ink storage unit with ink remaining in the printhead and ink conduit from the previous ink storage unit. This intermixing of ink colors tends to produce unpredictable colors reducing the quality of output images, and can result in chemical interactions between the residual ink and replacement ink which can result in unpredictable performance of the printhead.

Previously, ink containers have included simple mechanical keys to prevent the installation of the wrong ink container into a printer. As the number of ink families continues to increase, the available permutations provided by these simple mechanical have been substantially exhausted.

There is therefore an ever present need for systems that insure that ink containers having the proper ink parameters are correctly inserted into an ink jet printer. These systems should insure that the ink container is properly aligned so that proper fluid interconnect is provided between the ink container and the printhead. These systems should be cost effective and easily manufactured.

SUMMARY OF THE INVENTION

Embodiments of the present invention comprise containers for consumable substances, such as ink, and the corresponding receiving stations, such as inkjet printers. The containers and receiving stations have mating keying features indicative of a characteristic of the consumable substance, such as the ink family. Embodiments of the mating features include protuberances with a T-shaped cross section, and corresponding T-shaped slots. Preferred embodiments of containers and receiving stations are disclosed having two keying features with four unique orientations per feature, for a total 16 key permutations.

Other aspects and advantages of the present invention will become apparent from the following detailed description, taken in conjunction with the accompanying drawings, illustrating by way of example the principles of the invention.

BRIEF DESCRIPTION OF THE DRAWINGS

FIG. 4 is a detail perspective view of the rear portion of a typical ink container with which the keying mechanisms of the present invention may be used, showing the placement of the keying mechanisms;

FIG. 5 is a side view of a typical ink container with which the keying mechanisms of the present invention may be used;

DESCRIPTION OF THE PREFERRED EMBODIMENT

Figure 1:
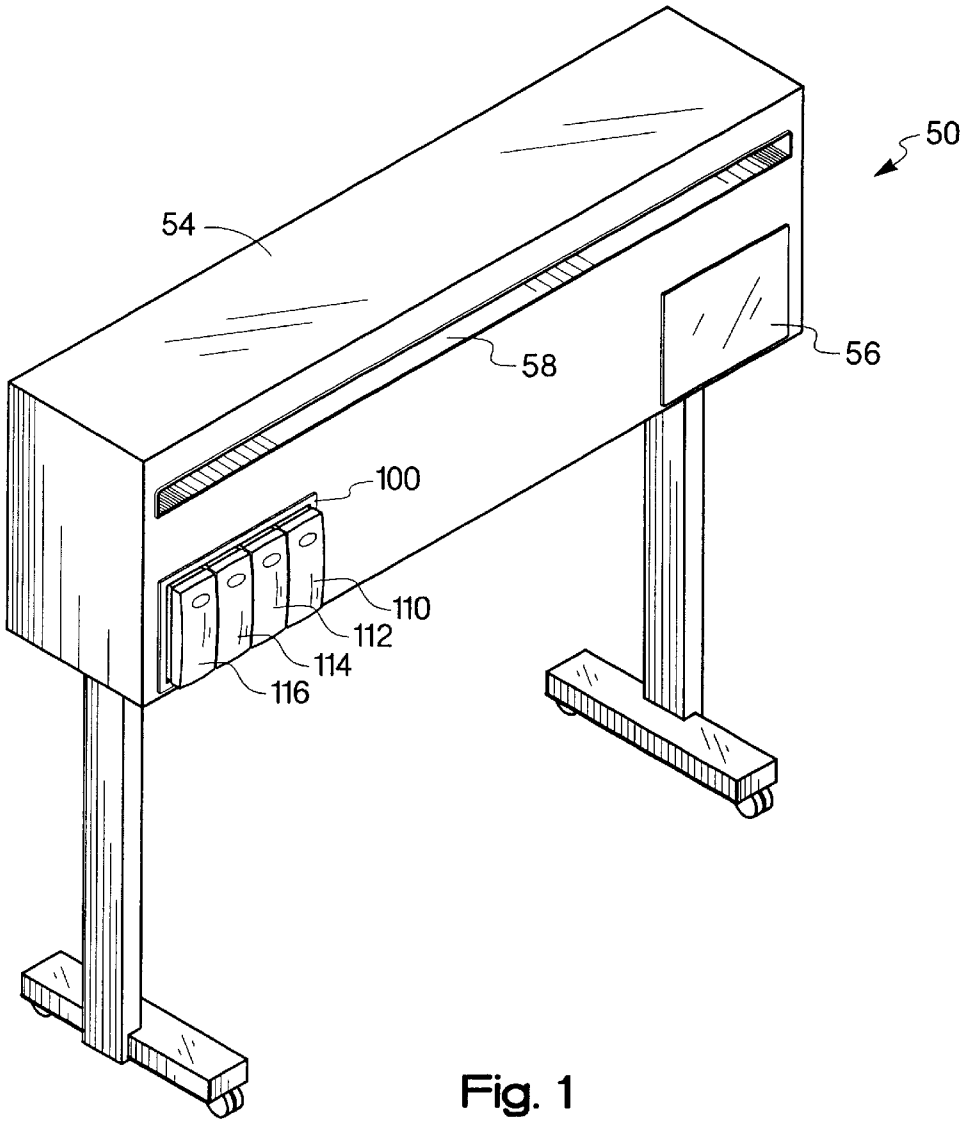
FIG. 1 is a front perspective view of a typical ink jet printing system in which the container keying mechanisms of the present invention may be incorporated.

FIG. 1 is a front perspective view of an exemplary embodiment of a large scale ink jet printing system 50 in which the container keying mechanisms of the present invention may be incorporated. The exemplary printing system depicted in FIG. 1 accommodates four off-carriage ink containers 110, 112, 114, 116 are shown in place in the ink supply station. The system includes a housing 54, a front control panel 56 which provides user control switches, and a media output slot 58 through which the media is output from the system after the printing operation. This exemplary system is fed from a media roll; alternatively sheet fed systems can also be used.

Figure 2:
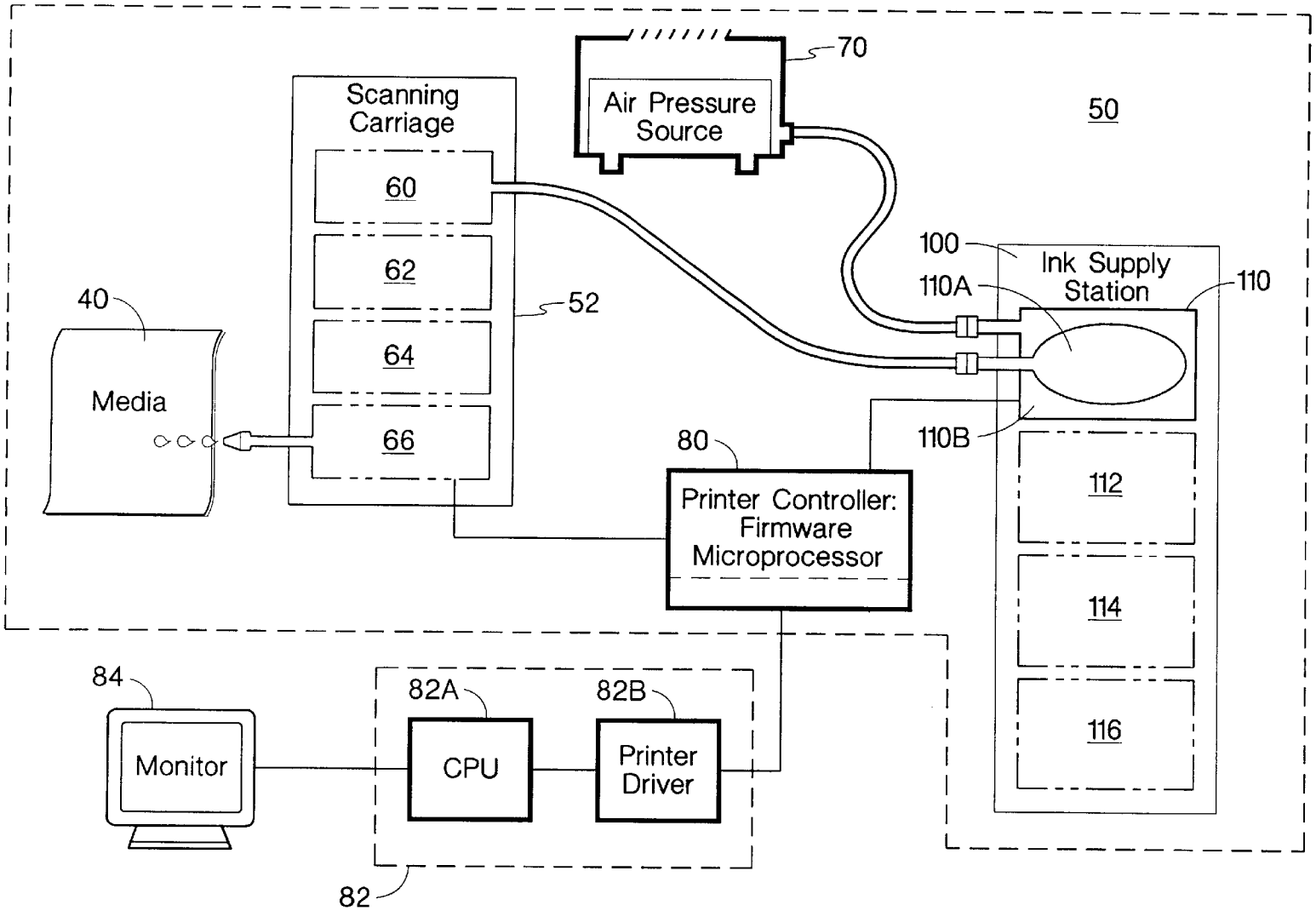
FIG. 2 is a block diagram of a typical ink jet printing system in which the container keying mechanisms of the present invention may be incorporated, showing how a plurality of ink containers in an "off-axis" ink supply station supply ink to printheads on a scanning carriage.

FIG. 2 shows an overall block diagram of a printer/-plotter system 50 embodying the invention. A scanning carriage 52 holds a plurality of high performance print cartridges 60, 62, 64, 66 that are fluidically coupled to an ink supply station 100. The supply station provides pressurized ink to the print cartridges. Each cartridge has a regulator valve that opens and closes to maintain a slight negative gauge pressure in the cartridge that is optimal for printhead performance. The ink being received is pressurized to eliminate effects of dynamic pressure drops.

The ink supply station 100 contains receptacles or bays for slidably mounting ink containers 110, 112, 114, 116. Each ink container has a collapsible ink reservoir, such as reservoir 110A that is surrounded by an air pressure chamber 110B. An air pressure source or pump 70 is in communication with the air pressure chamber for pressurizing the collapsible reservoir. Pressurized ink is then delivered to the print cartridge, e.g. cartridge 66, by an ink flow path. One air pump supplies pressurized air for all ink containers in the system. In an exemplary embodiment, the pump supplies a positive pressure of 2 psi, in order to meet ink flow rates on the order of 25 cc/min. Of course, for systems having lower ink flow rate requirement, a lower pressure will suffice, and some cases with low throughput rates will require no positive air pressure at all.

The scanning carriage 52 and print cartridges 60, 62, 64, 66 are controlled by the printer controller 80, which includes the printer firmware and microprocessor. The controller 80 thus controls the scanning carriage drive system and the print heads on the print cartridge to selectively energize the print heads, to cause ink droplets to be ejected in a controlled fashion onto the print medium 40.

The system 50 typically receives printing jobs and commands from a computer work station or personal computer 82, which includes a CPU 82A and a printer driver 82B for interfacing to the printing system 50. The work station further includes a monitor 84.

Figure 3:
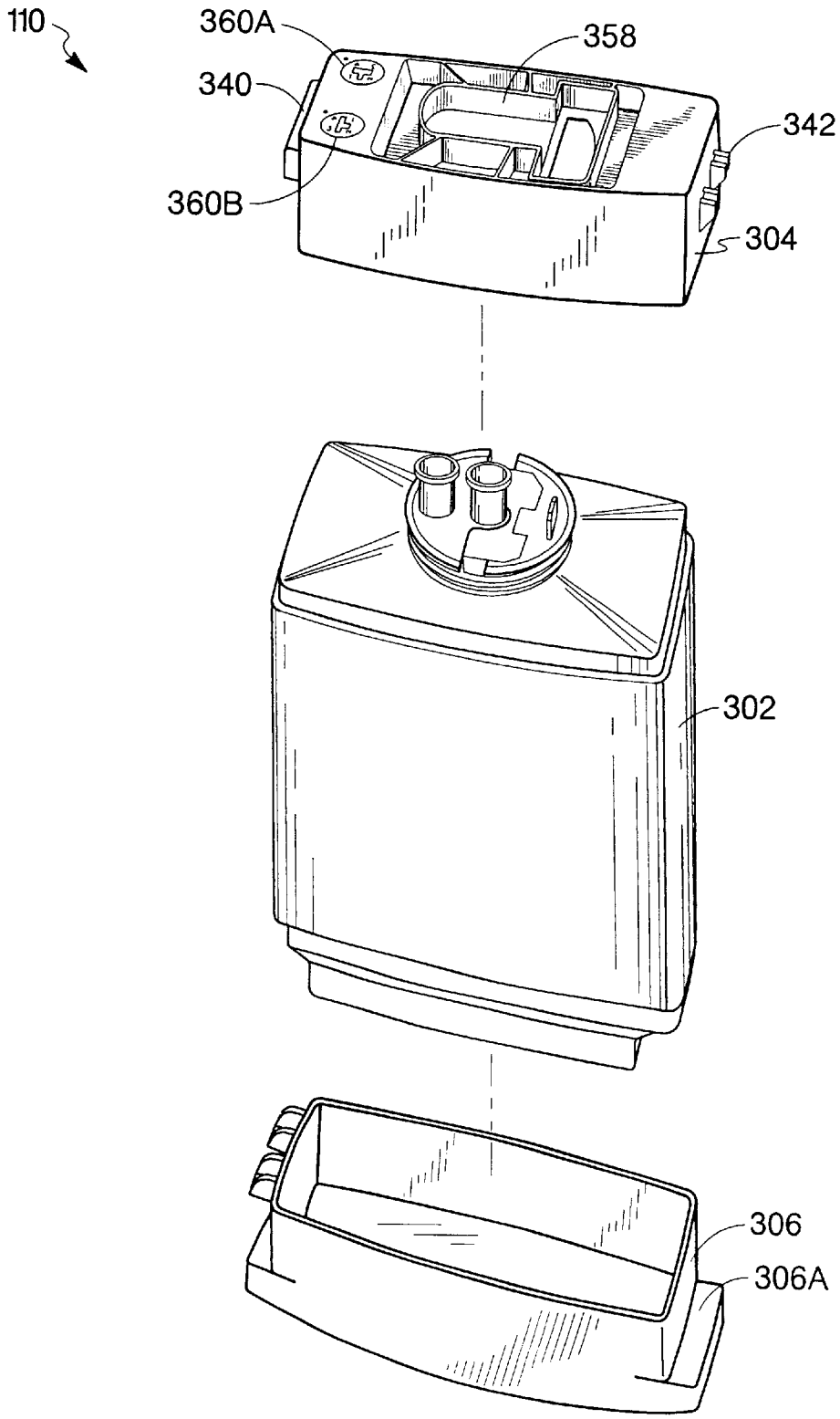
FIG. 3 is an exploded view of a typical ink container with which the keying mechanisms of the present invention may be used.

As shown in FIG. 3, an exemplary ink container 110 utilizing the present invention has two end caps 304, 306 which are separately attached to the pressure vessel 302. With this exemplary embodiment, the mechanical functions include an oversized end 306 that prevents backwards insertion of the ink container into the supply station. For the leading end cap 304, the mechanical functions include a boss 358 for protecting the container interconnects, prior art keying features 340, 342 to assure that the ink container 110 is installed in the proper ink supply station location, and aligning features to assure proper positioning of the ink container into the supply station. The T-slot keying features of the present invention are shown at 360A and 360B.

FIG. 4 is a more detailed perspective view of the rear portion of a typical ink container 110 with which the keying mechanisms 360A, 360B of the present invention may be used, showing the placement of the keying mechanisms relative to the other features on the endcap 304. The ink container includes a tower shaped air inlet 308 for receiving pressurized air from a printing system and a tower shaped ink outlet 310 for delivering pressurized ink to the system. The air inlet and ink outlet, accessible on the leading edge of the container, extend approximately equal distances beyond an exterior surface of the ink container. The chassis 302 provides a surface for container electrical contacts 356 associated with the printing system. In a preferred embodiment, the chassis provides all of this functionality with a single integral part. Using an integral part improves manufacturability and relative locational accuracy of the parts included in the chassis.

FIG. 5 is a side view of a typical ink container with which the keying mechanisms of the present invention may be used, showing the two end caps 304, 306 attached to the pressure vessel 302.

Figure 6:
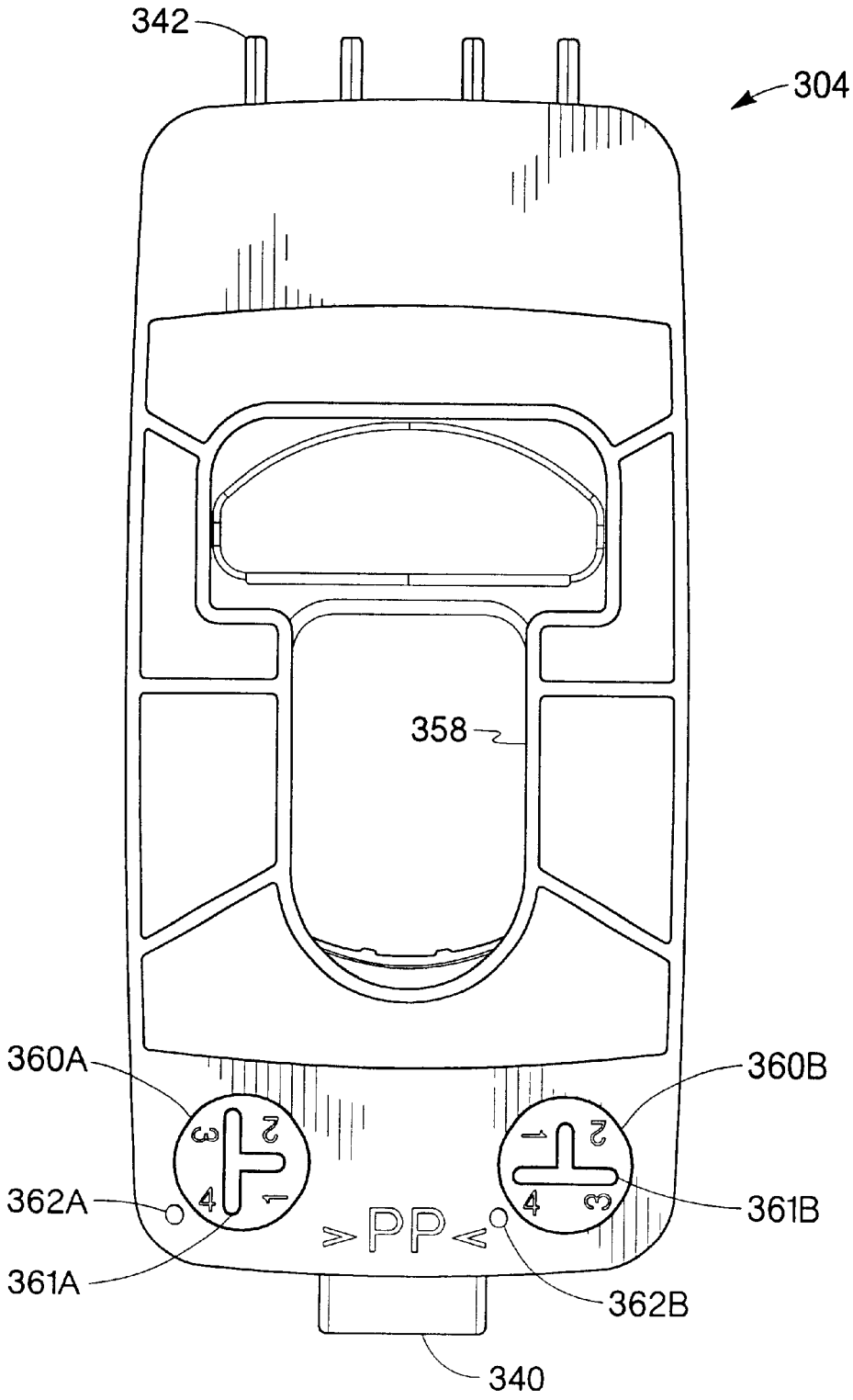
FIG. 6 is rear plan view of a typical ink container with which the keying mechanisms of the present invention may be used, further illustrating how the orientations of the keying features are designated.

FIG. 6 is a more detailed plan view of the leading end cap 304, showing the T-slot keying features 360A, 360B of the present invention in relation to the boss 358 for protecting the container interconnects, and prior art keying features 340, 342. In the exemplary embodiment, the keying features 360A, 360B and are integrally molded with the end cap. The keying features comprise T-shaped openings 361A, 361B through the end cap, which accept T-shaped mating features, as discussed below. Also as discussed below, the T-Slot mold inserts which form the T-slots are indexable at 90 degree increments for a total of 4 unique positions per T-Slot. For visually identifying the keying of a container, the four positions (1, 2, 3, 4) are numerically indicated on the molded end cap. Slightly depressed circles 362A, 362B located outside the circumference of each T-Slot insert indicates which of the 4 integers to read.

Figure 7:
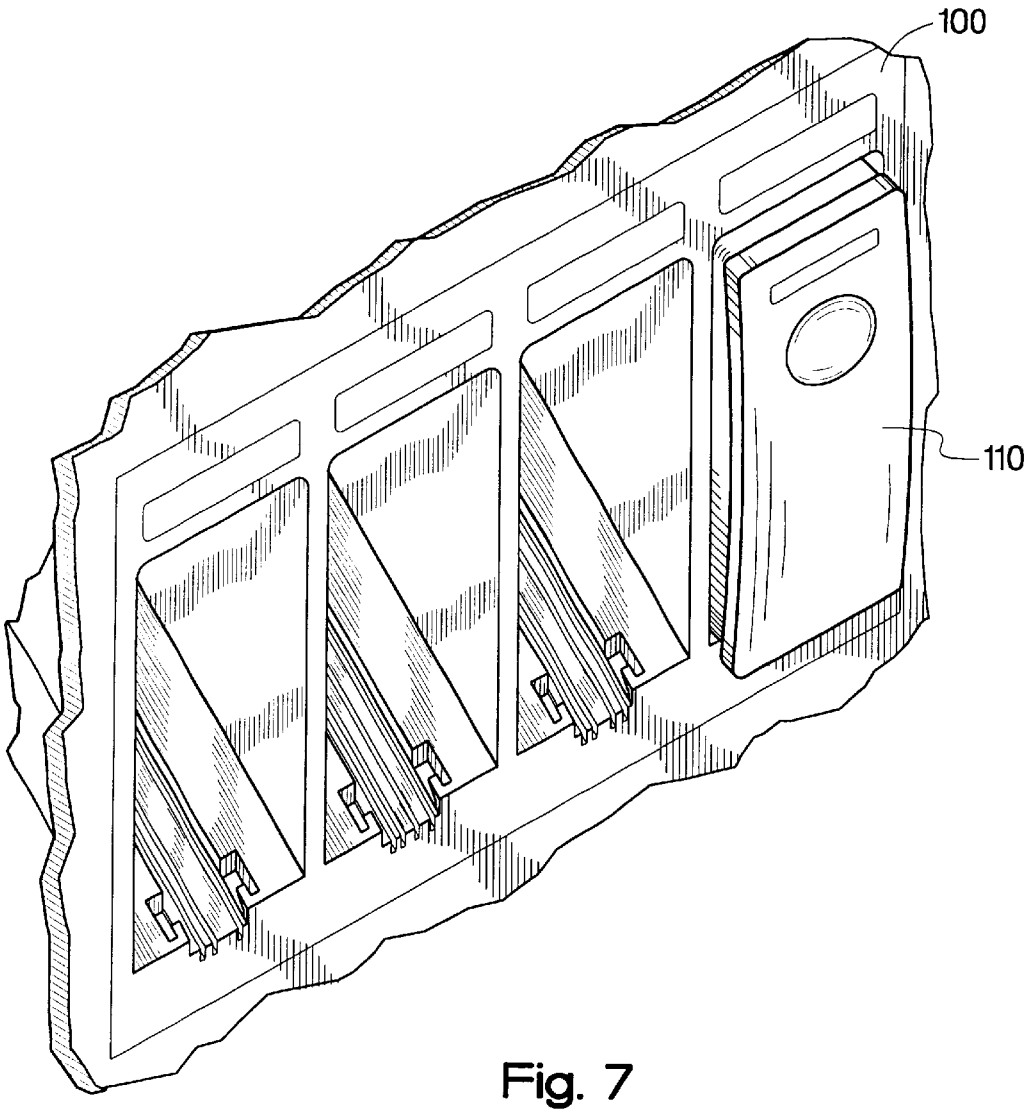
FIG. 7 is a partial front perspective view of a typical inkjet printing system in which the container keying mechanisms of the present invention may be incorporated, illustrating how containers are inserted into the supply station.

FIG. 7 is a partial front perspective view of a typical ink jet printing system in which the container keying mechanisms of the present invention may be incorporated, illustrating how a container 110 is inserted into the supply station 100. The trailing cap 306 provides an enlarged head to prevent backward insertion in the ink supply station 100. The trailing end cap may include a visual indication (not illustrated in FIG. 7) of the color of the ink disposed within the container, to aid the user in identifying the cartridge.

Figure 8:
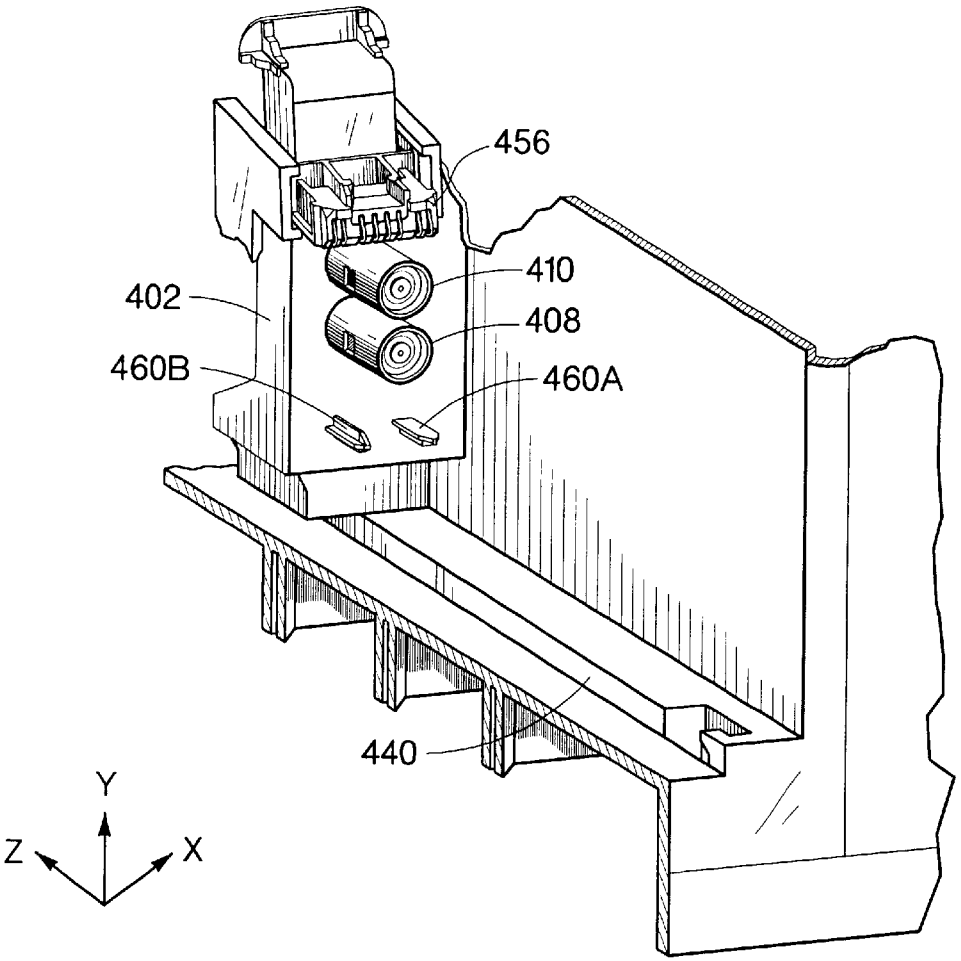
FIG. 8 is a cutaway perspective view of one ink container slot in a typical ink jet printing system in which the container keying mechanisms of the present invention may be used, showing the mating keying features.

FIG. 8 shows a cross-section of a single ink container receiving slot within the ink container receiving station 100. The ink container receiving slot includes interconnect portions for interconnecting with the ink container. In the preferred embodiment these interconnect portions include a fluid inlet 410, and air outlet 408 and an electrical interconnect portion 456. The mating T-slot features 460A, 460B of the present invention are located below the air outlet. Each of the interconnects 410, 408, 456 and the T-slot mating features 460A, 460B are positioned on a floating interconnect portion 402 which is biased along the Z-axis toward the installed ink container.

The fluid inlet 410 and the air outlet 408 associated with the ink container receiving station are configured for connection with the corresponding fluid outlet 310 and air inlet 308, respectively on the ink container. The electrical interconnect 456 is configured for engaging the plurality of electrical contact 356 on the ink container. Guide slots in the ink container receiving station receive the prior art keying and guide features 340, 342 to guide the container during installation to a mating position with respect to the floating interconnect portion 402; only a lower guide slot 440 is illustrated in FIG. 8.

Figure 9:
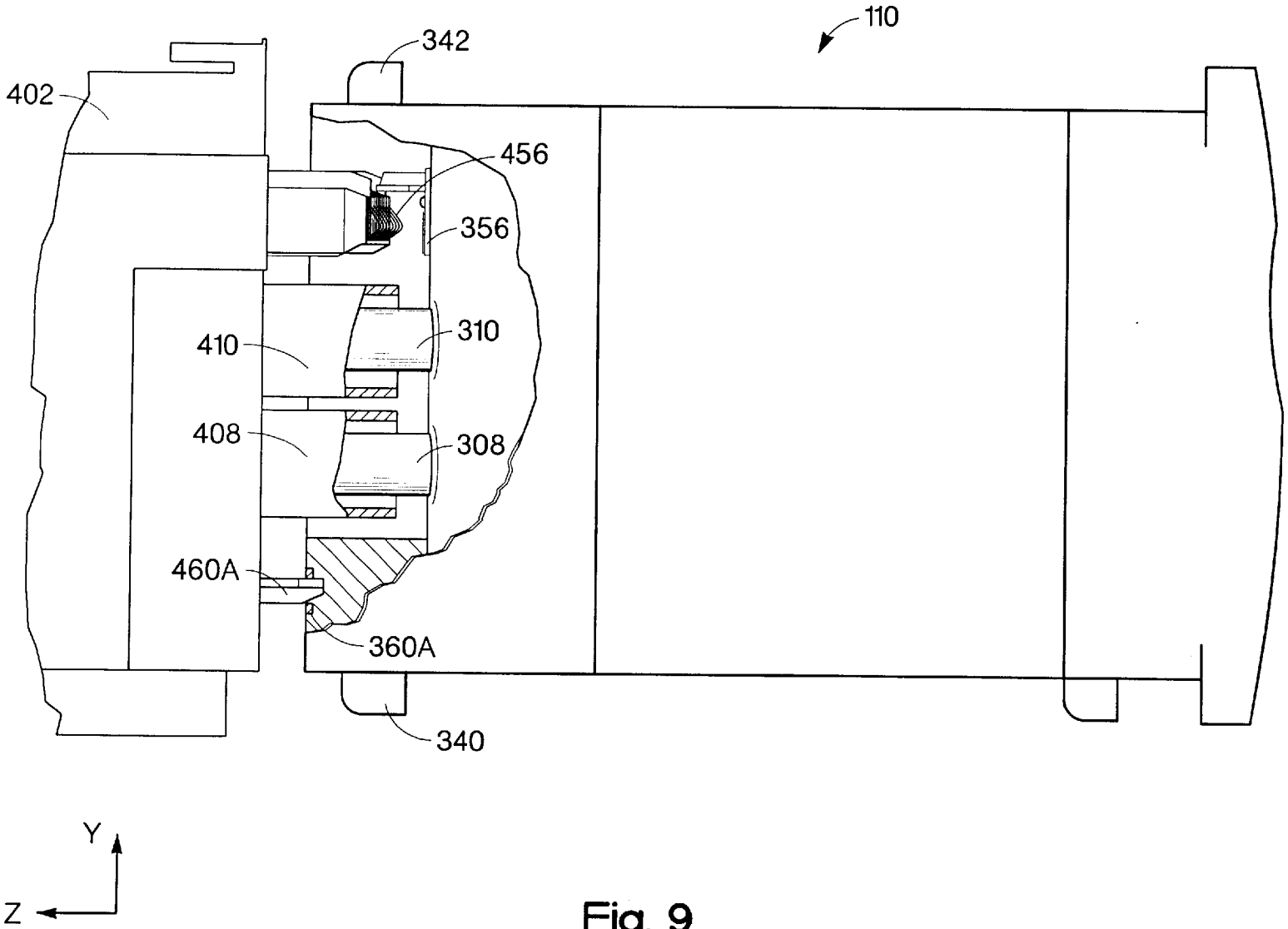
FIG. 9 is a partial cutaway side view of a container being installed in a container slot, with the T-slot keying feature of the present invention beginning to engage the mating keying feature.

As shown in FIG. 9, insertion of the ink container 110 into the ink container receiving station results in the outwardly extending fluid outlet 310 and air inlet 308 engaging the corresponding housing associated with the fluid inlet and air outlet 410 and 408, respectively on the ink container receiving station. As the fluid and air interconnects 310 and 308 engage the housing members 410 and 408, respectively, the floating interconnect 402 is aligned along the X and Y axis with the ink container 110. In the preferred embodiment, the electrical interconnect 356 fluid outlet 310, and air inlet 308 are all formed integrally on the same chassis portion of ink container 110. Therefore, alignment of the floating interconnect portion 402 with the fluid outlet 310 and air inlet 308 provides a course alignment of the electrical interconnect 356 with mating connector 456 and the T-slots 360A with the mating feature 460A.

As the ink container 110 is further inserted into the ink container receiving station, the tapered portion on each T-slot mating feature 460A, 460B engage the corresponding T-slots to help guide the mating features into the T-slots.

Figure 10:
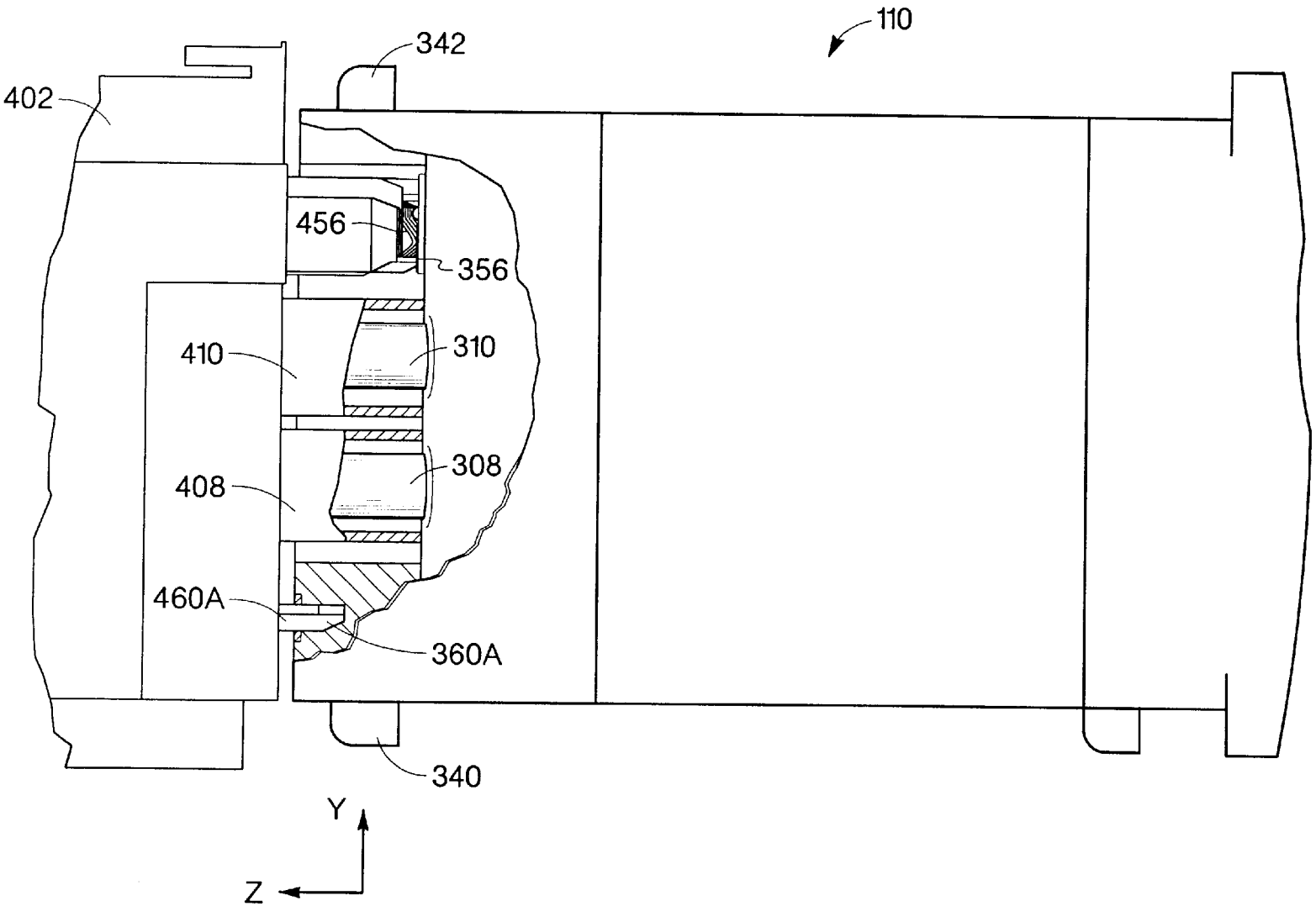
FIG. 10 is a partial cutaway side view of a container being installed in a container slot, with the mating keying features fully engaged.

FIG. 10 shows the ink container 110 fully inserted into the ink container receiving station. In this fully inserted position proper fluid, air, and electrical interconnects are formed between the ink container and the ink container receiving station. The T-slot mating features 460A, 460B have fully engaged the T-slots 360A, 360B.

Figure 11:
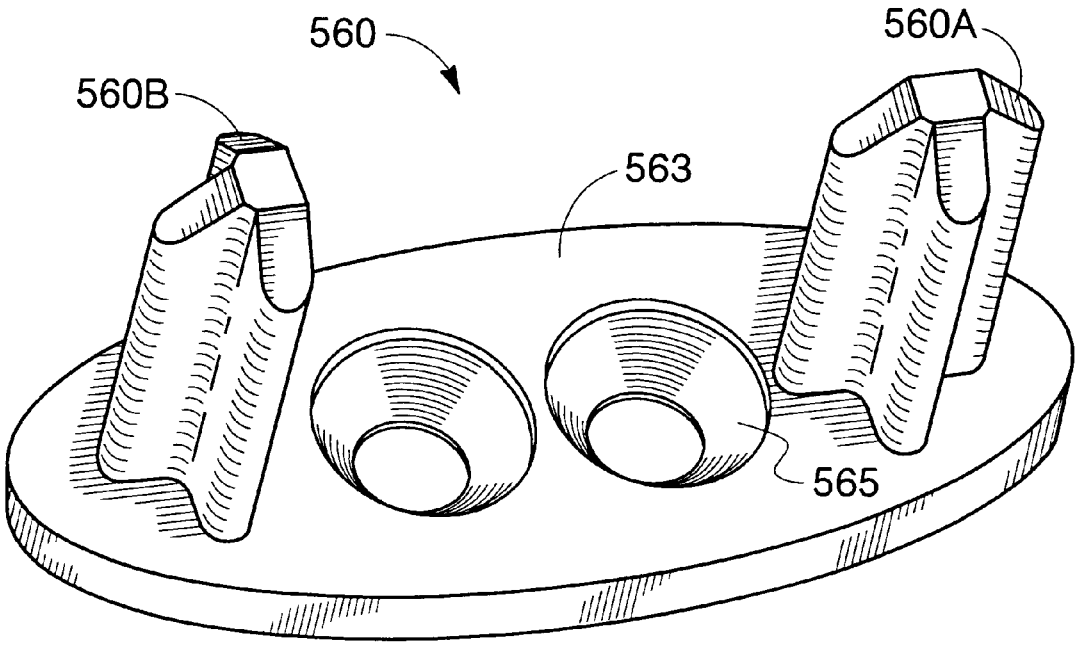
FIG. 11 is an embodiment of a mating T-boss plate incorporating the keying mechanisms of the present invention.

FIG. 11 is an embodiment of a mating T-boss plate incorporating the keying mechanisms of the present invention. The two T-slot mating features 560A, 560B are integrally formed with a mounting plate 563; the mounting plate may include countersunk holes 565 to accept mounting screws.

Figure 12:
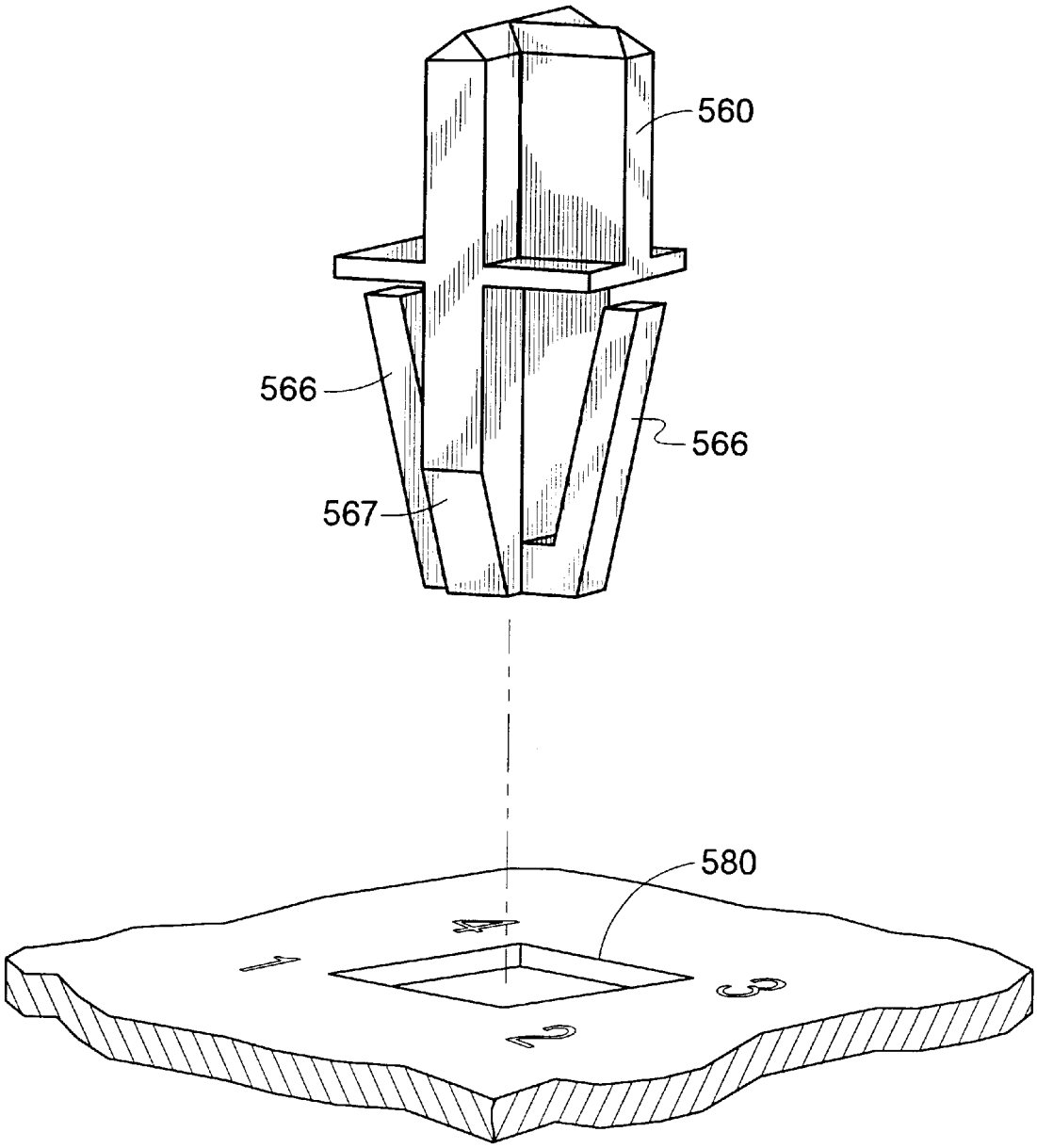
FIG. 12 is another embodiment of a mating T-boss component incorporating the keying mechanisms of the present invention.

FIG. 12 is another embodiment of a mating T-boss component incorporating the keying mechanisms of the present invention. The embodiment depicted in FIG. 12 allows for easy "personalizing" an ink container slot in a post-manufacturing environment. The T-slot mating features are integrally formed with flexible finger members 566 and guide members 567, which allow semi-permanent placement of the mounting feature in a square mounting hole 580.

Figure 13:
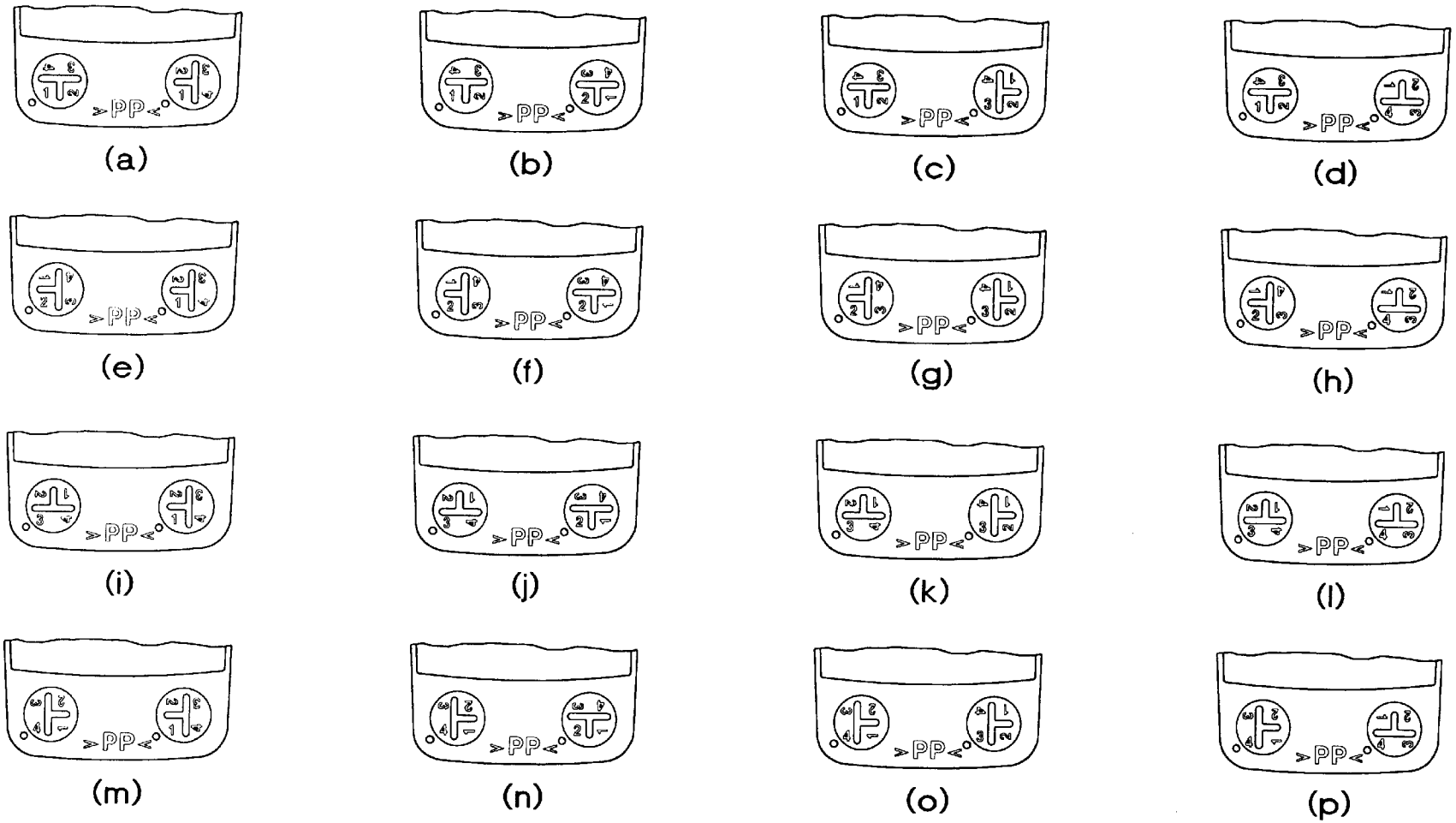
FIGS. 13(*a*) through 13(*p*) indicate the different keying arrangements provided an embodiment of the present invention having two T-slot features.

FIGS. 13(*a*) through 13(*p*) indicate the different keying arrangements provided an embodiment of the present invention having two T-slot features. Two T-slots, each having 4 possible orientations, provide a total of 16 keying possibilities.

Figure 14:
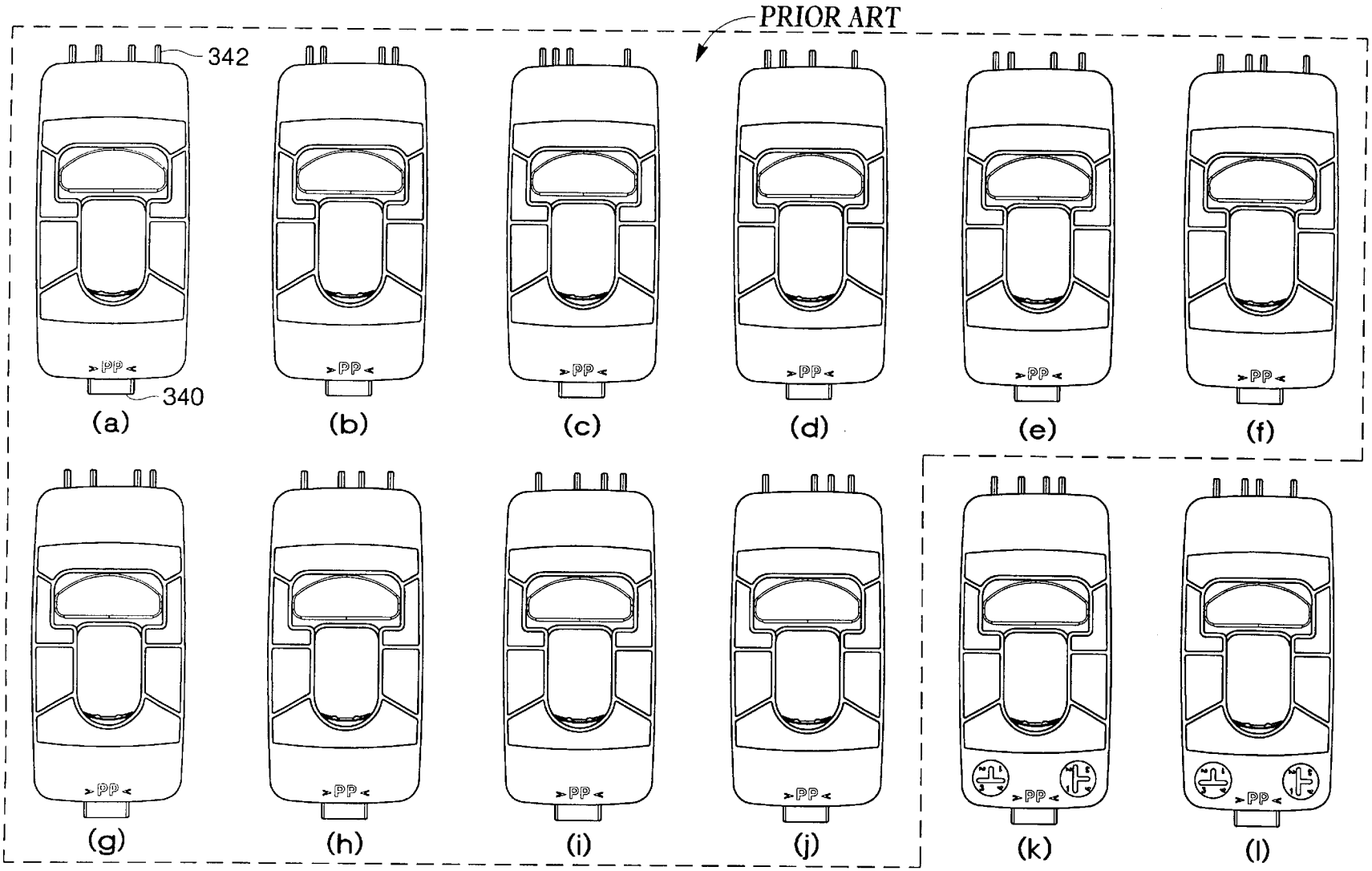
FIGS. 14(*a*) through 14(*l*) illustrate how the keying features of the present invention may be combined with prior art keying and guide features to provide additional uniquely-keyed containers within an existing family of ink containers.

FIG. 14 illustrates how the keying features of the present invention maybe combined with current keying methods to extend the number of unique keys available. As shown at FIG. 14(*a*), an upper set 342 of prior art keying elements denote the container ink type; a lower set 340 of keying elements denote ink color. The ten upper keying arrangements shown in FIGS. 14(*a*) through 146(*j*) represent keying arrangements currently assigned to ink types. The upper keying arrangements depicted in FIGS. 14(*k*) and 14(*l*) are currently not assigned. By reserving these two ink-type keys for use in conjunction with the added T-slot keys, the number of additional ink types which may be uniquely identified is increased by 32 (16 T-slot permutations for each of the ink-type keys).

Figure 15:
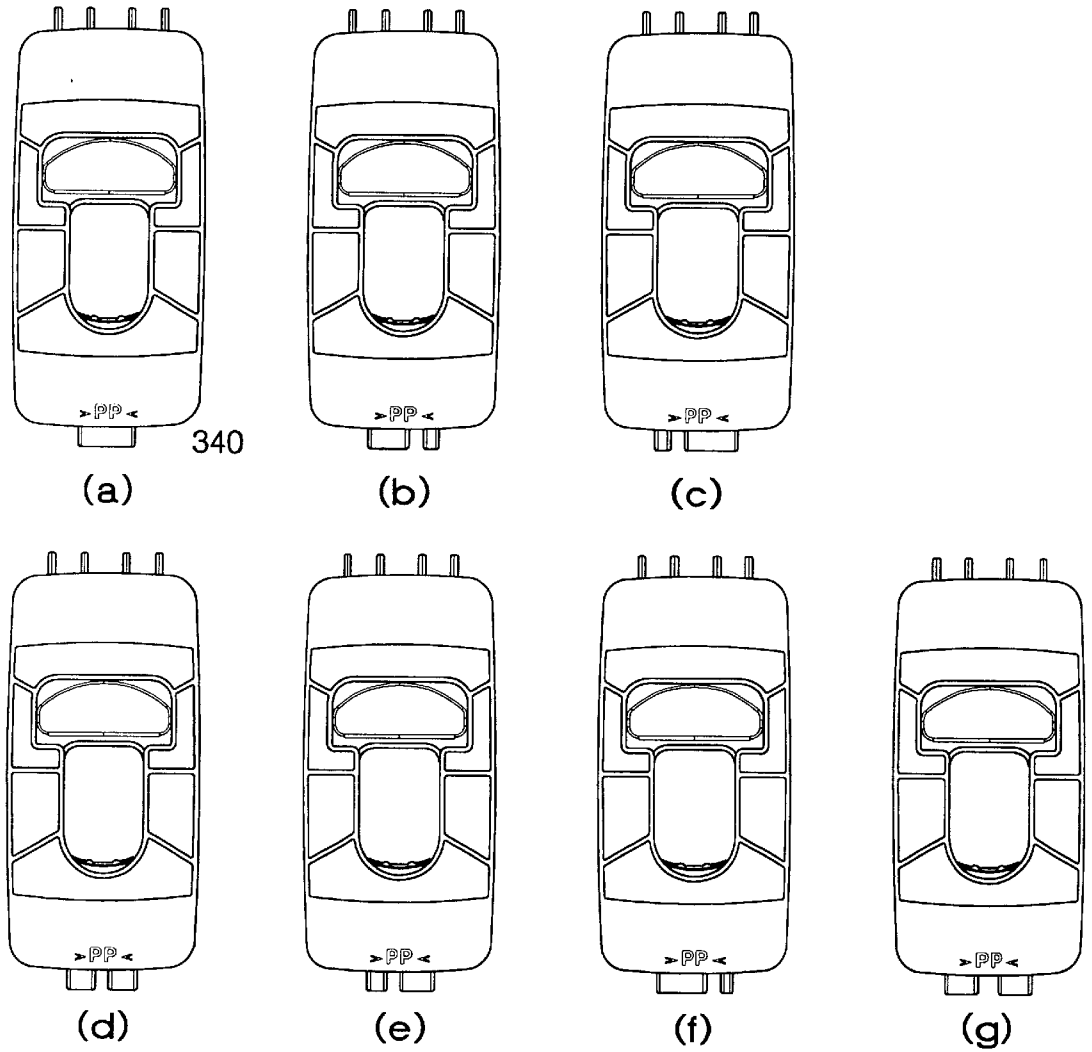
Fig. 15 (PRIOR ART)
FIG. 15 illustrates a prior art keying arrangement used to designate ink color, which may be utilized in conjunction with the keying features of the present invention.

FIG. 15 illustrates various prior art "color" keys which may be used in conjunction with the T-slot keys of the present invention.

Figure 16:
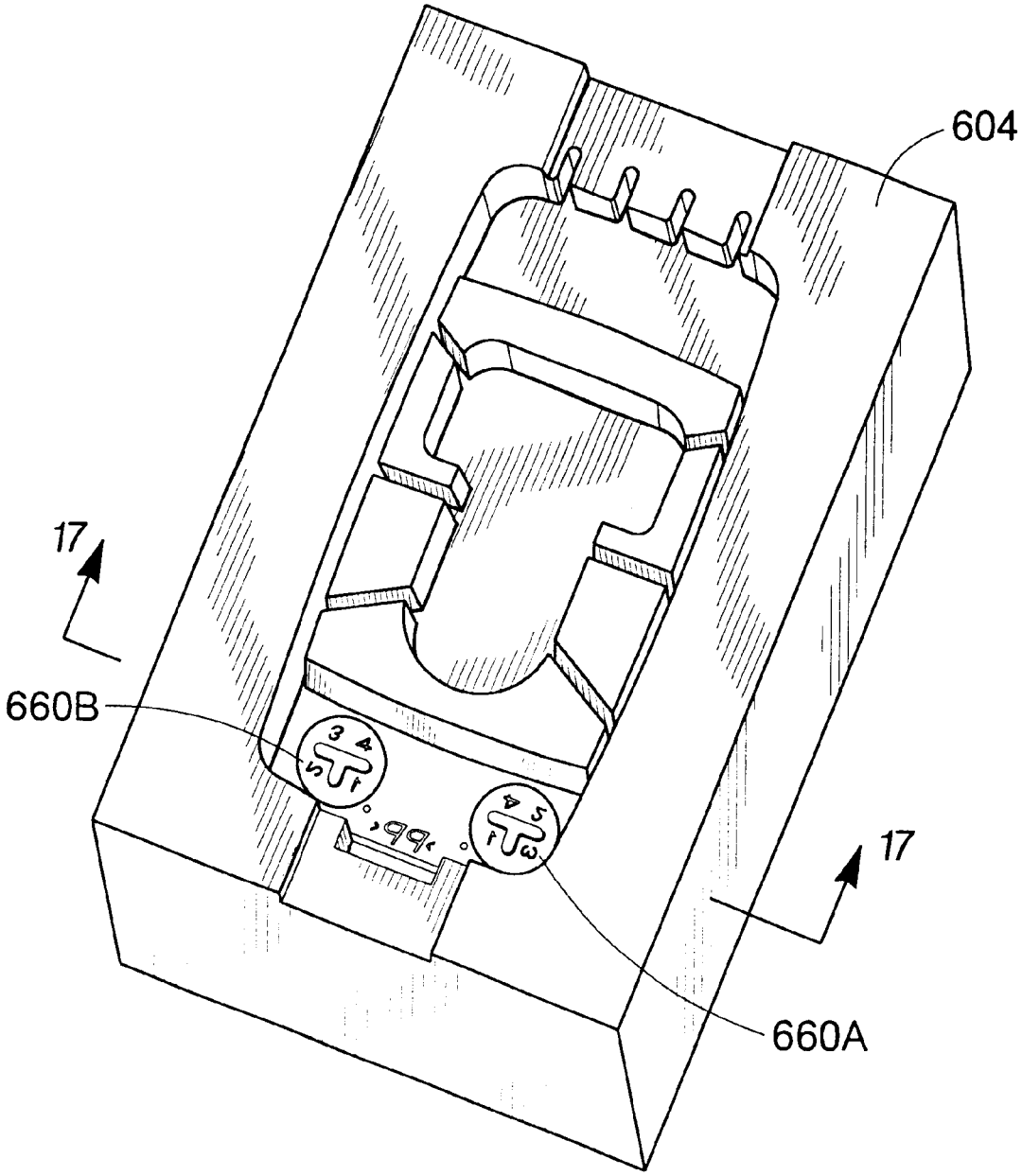
FIG. 16 is a perspective view of a mold device for forming the end piece of a typical container with which the keying mechanisms of the present invention may be used, showing how a t-slot feature may be incorporated into the mold.

FIG. 16 is a perspective view of one of the two mold parts 604 used for forming the end piece 304 of a typical container with which the keying mechanisms of the present invention may be used. The mold part depicted in FIG. 16 forms the outer surface of the end cap; the corresponding mold part forming the inner surface is not shown. The mold includes negative impressions 660A and 660B of the T-slot features.

Figure 17:
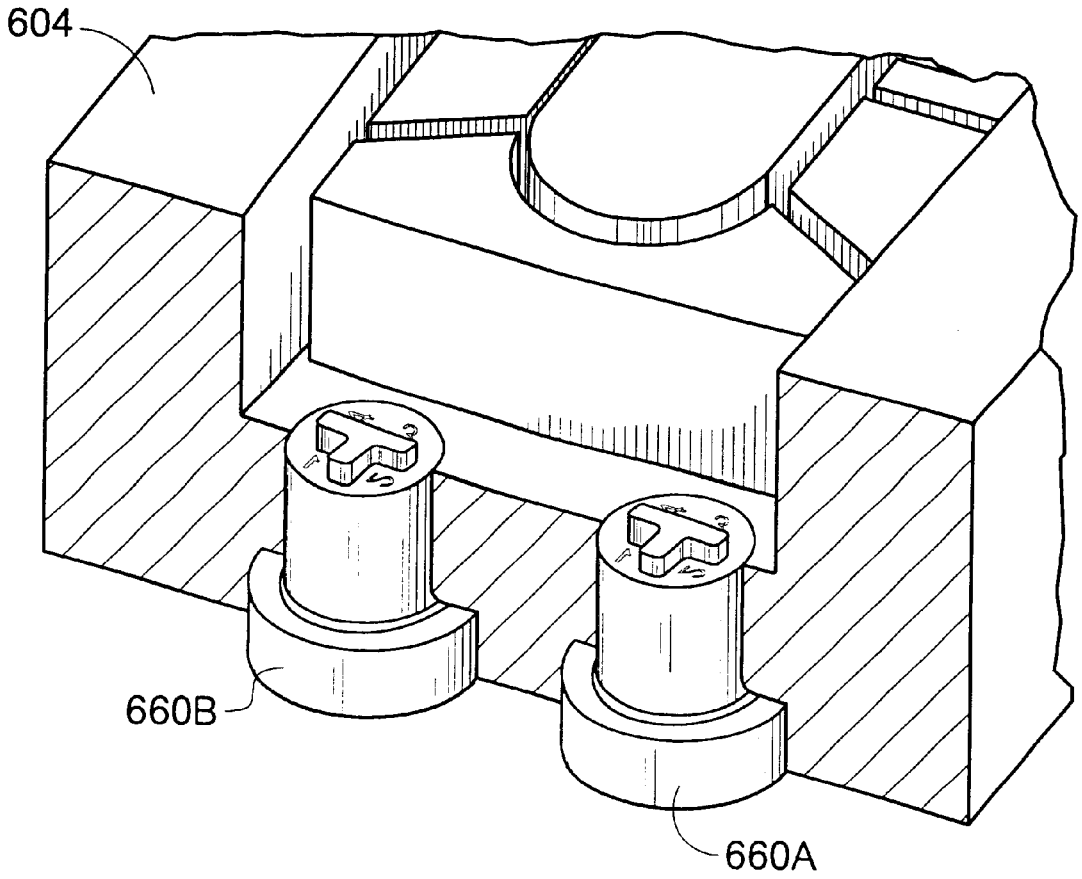
FIG. 17 is a sectional view along line 17—17 of FIG. 16, indicating how the t-slot feature of the mold may comprise a rotating core, reducing the number of different molds required in the manufacture of the ink containers.

FIG. 17 is a sectional view along line 17—17 of FIG. 16, indicating how the T-slot feature of the mold may comprise a rotating core, reducing the number of different molds required in the manufacture of the ink containers. When producing ink container end caps for a particular ink, the rotating cores 660A and 660B may be rotated to the proper key positions for that ink type.

Figure 18:
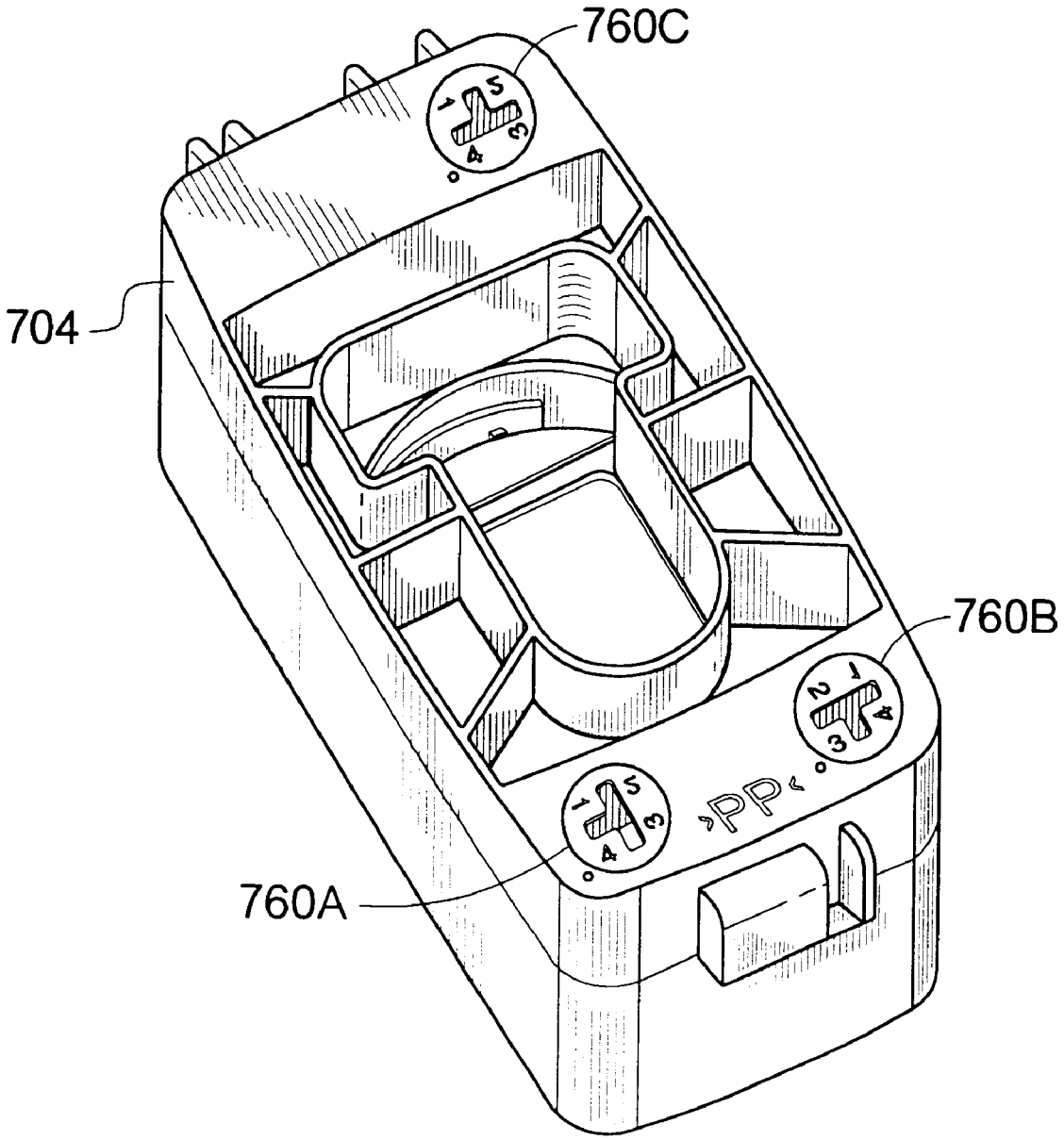
FIG. 18 is a perspective view of an alternate embodiment of the present invention, in which three T-slot keying features are provided on an ink container.

FIG. 18 is a perspective view of an alternate embodiment of the present invention, in which three T-slot keying features 760A, 760B, 760C are provided on an ink container end cap 704. The alternate embodiment thus increases the number of unique keys available by a factor of four.

Figure 19:
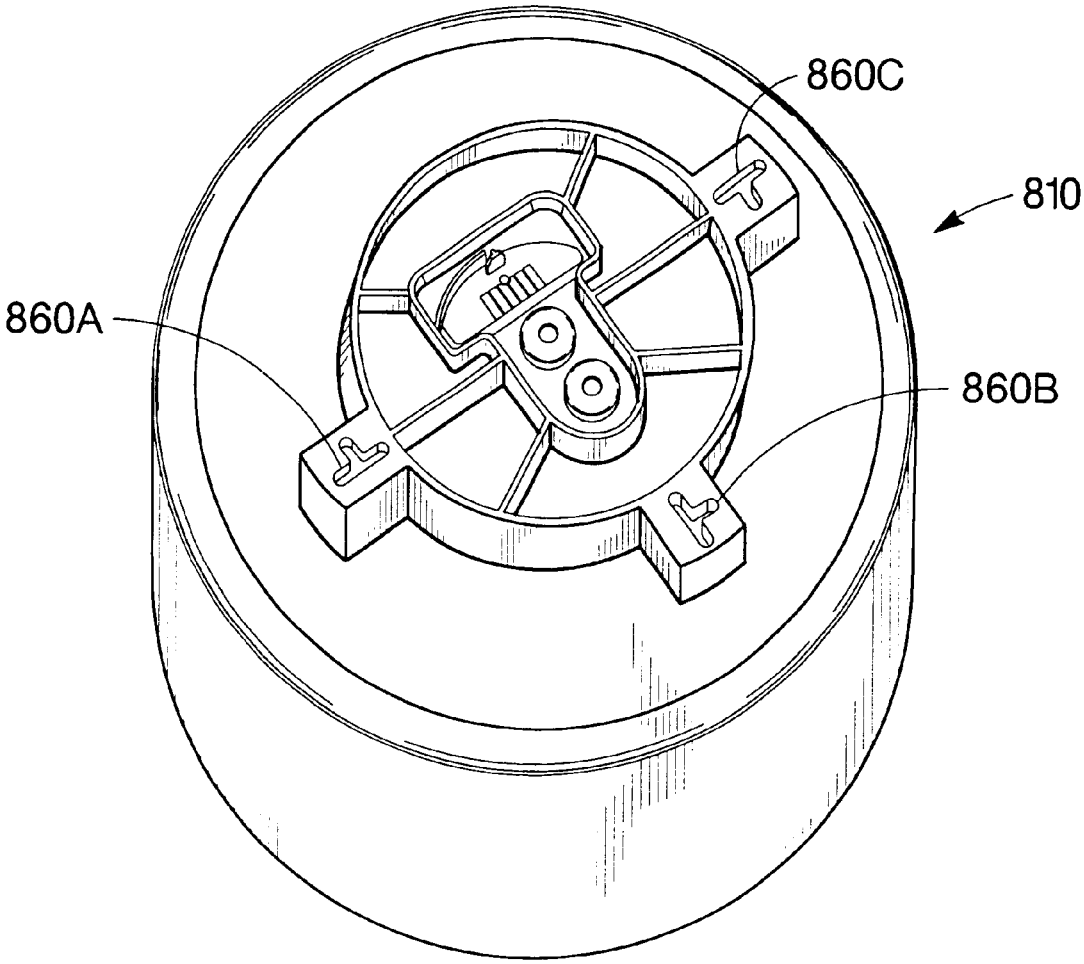
FIG. 19 is a perspective view illustrating the use of the keying features of the present invention on a cylindrical ink container.

FIG. 19 is a perspective view illustrating the use of the keying features of the present invention on a cylindrical ink container 810. The cylindrical container allows for larger ink volumes than square containers. The embodiment depicted in FIG. 19 includes three T-slot features 860A, 860B, and

860C. The T-slot features may be the only keying features used on the container, or may be used in conjunction with any other keying methods known in the art.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. An ink container for replaceable attachment to an inkjet printer receiving-station, said receiving-station having a plurality of guide slots, the guide slots defining a container installation direction and serving to facilitate slidable mating of the container, the guide slots disposed in a first keying configuration, the ink container comprising:

a leading end cap;

a first keying feature comprising tabs extending from the leading end cap for engaging printer receiving-station guide slots;

the leading end cap having a surface substantially orthogonal to the installation direction;

a second keying feature comprising an opening in the substantially orthogonal surface, the opening operable to physically receive a mating key within a printer receiving-station, the opening substantially having the shape of a "T".

2. The ink container of claim 1, wherein the T shape is angularly-oriented in one of four orientations corresponding to 90 degree angular increments.

3. The ink container of claim 1, wherein the second keying feature comprises a plurality of openings in the substantially orthogonal surface, each opening substantially having the shape of a "T".

4. An ink container for replaceable attachment to an inkjet printer receiving-station, said receiving-station having a top portion and a bottom portion, said top and bottom portions each having a plurality of guide slots, the guide slots defining a container installation direction and serving to facilitate slidable mating of the container, the guide slots disposed in a first keying configuration, the ink container comprising:

a leading end cap having a top portion and a bottom portion;

a first keying feature comprising tabs extending from both the top and bottom portions of the leading end cap for engaging printer receiving-station guide slots;

the leading end cap having a surface substantially orthogonal to the installation direction;

a second keying feature comprising two openings in the substantially orthogonal surface, the openings operable to physically receive mating keys within a printer receiving-station, the openings substantially having the shape of a "T".

5. A printer receiving-station for replaceable attachment of an ink supply, the receiving-station comprising:

a plurality of guide slots, the guide slots defining a container installation direction and disposed in a configuration forming a first mechanical key for a mating ink container;

a substantially flat portion orthogonal to the container installation direction;

interconnecting protuberances extending normal to the substantially flat portion, the protuberances having flattened elongated cross sections and oriented such that the interconnecting cross sections of the protuberances form a distinctive pattern in the shape of a letter "T" operable to serve as a second mechanical key for a mating ink container.

6. The inkjet printer receiving station of claim 5, wherein the T shape pattern is angularly-oriented in one of four orientations corresponding to 90 degree angular increments.

7. The inkjet printer receiving station of claim 5, wherein the second keying mechanism comprises a plurality of interconnecting protuberances extending normal to the substantially flat portion.

* * * * *